United States Patent [19]

Colglazier et al.

[11] 4,113,245

[45] Sep. 12, 1978

[54] COMBING WHEEL FEED NIP WITH SECOND SHEET RESTRAINT

[75] Inventors: Donald Francis Colglazier; John Leslie Fallon; Ernest Paul Kollar, all of Longmont; Fred Ralph Mares, Boulder, all of Colo.

[73] Assignee: International Business Machines Corporation, Armonk, N.Y.

[21] Appl. No.: 788,570

[22] Filed: Apr. 18, 1977

[51] Int. Cl.[2] ..... B65H 3/52

[52] U.S. Cl. ..... 271/10; 271/37; 271/121

[58] Field of Search ..... 271/37, 38, 110, 111, 271/265, 246, 245, 237, 121, 124, 125, 151, 273, 274, 10, 118, 127

[56] References Cited

U.S. PATENT DOCUMENTS

| | | | |
|---|---|---|---|
| 576,116 | 2/1897 | Hansen | 271/121 |
| 748,279 | 12/1903 | Hallberg | 271/121 |
| 856,347 | 6/1907 | Jahn | 271/121 |
| 1,151,808 | 8/1915 | Middleditch | 271/38 |
| 2,363,357 | 11/1944 | Post | 271/118 |
| 3,588,094 | 6/1971 | Bost | 271/121 |
| 3,640,524 | 2/1972 | Fredrickson | 271/121 |
| 3,885,782 | 5/1975 | Wright et al. | 271/10 |

*Primary Examiner*—Bruce H. Stoner, Jr.
*Attorney, Agent, or Firm*—Francis A. Sirr

[57] ABSTRACT

A multibin, cut-sheet xerographic copier capable of operating in a simplex or a duplex copy mode, wherein sheets are fed from a selected sheet stack, one at a time, to the copier's transfer station, by a sheet feeding means which includes a combing wheel. The combing wheel shingles the top few sheets, and particularly the single top sheet's leading edge, to a normally open feed nip. This nip is closed by copier logic to feed the top sheet to the transfer station. The feed nip comprises a fixed position, continuously rotating feed roller adapted to cooperate with the top surface of the top sheet. A solenoid controlled, nip-closing, composite pad is pivotable upward to press the top sheet against the feed roller. This composite pad includes a first low friction, nonresilient pressure pad cooperating with the feed roller, and a second, reduced thickness, resilient pad cooperating with the leading edge of the shingled sheets under the top sheet. A spring biases all shingled sheets away from the feed roller and toward the solenoid controlled composite pad.

11 Claims, 19 Drawing Figures

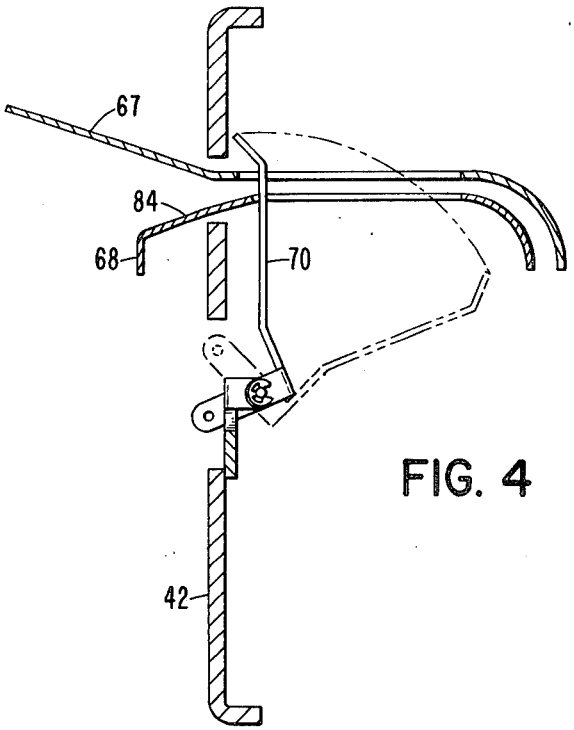
FIG. 4
FIG. 6
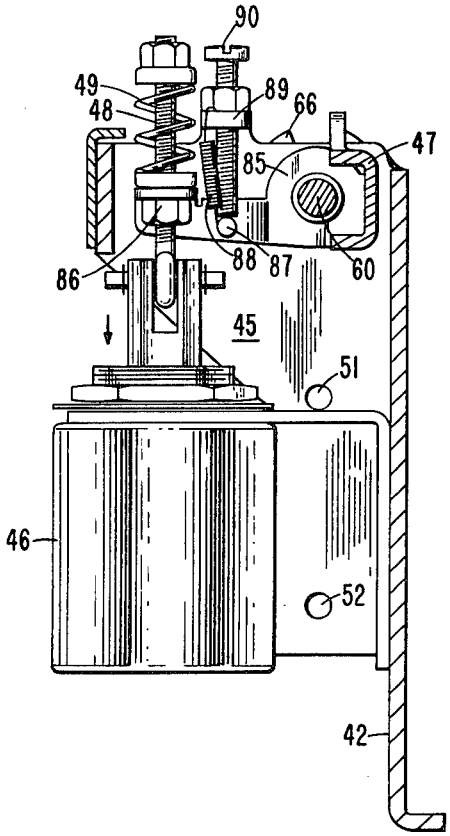

FIG. 8
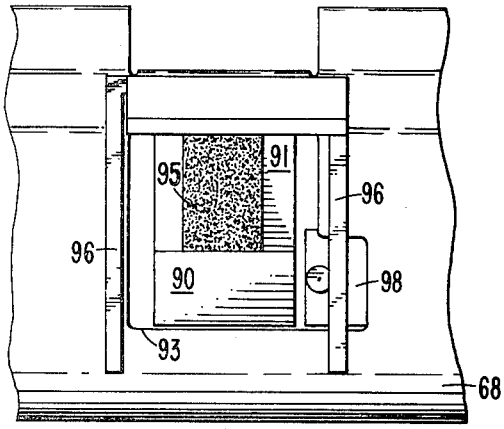
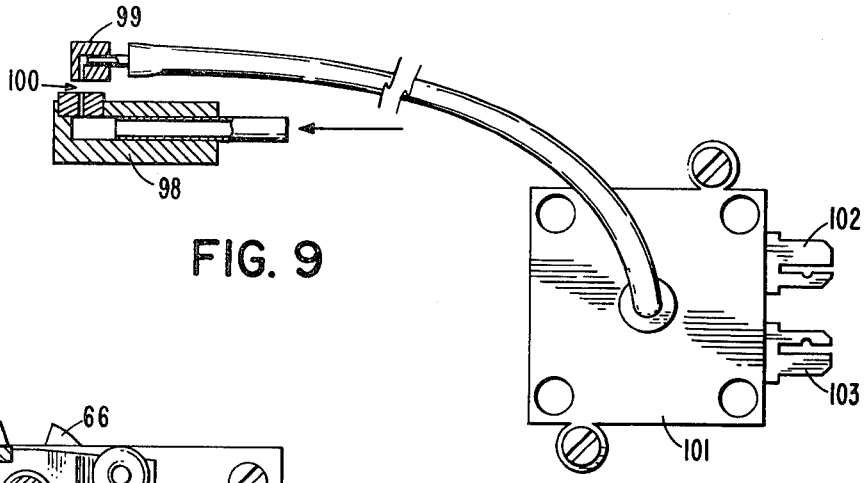
FIG. 9
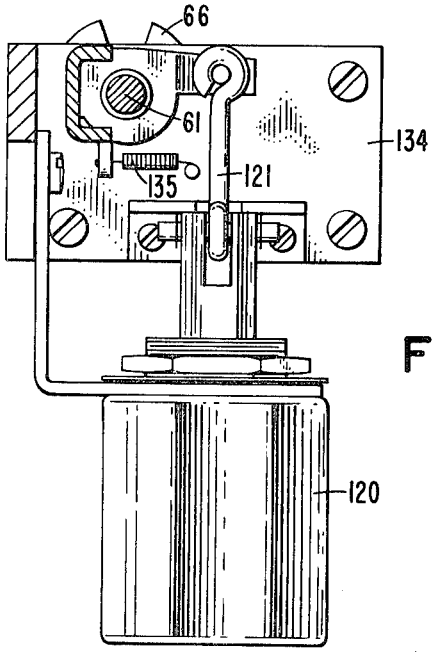
FIG. 16

COMBING WHEEL FEED NIP WITH SECOND SHEET RESTRAINT

CROSS-REFERENCE TO RELATED APPLICATIONS

Copending applications Ser. Nos. 788,471 and 788,574, filed Apr. 18, 1977 and Apr. 18, 1977, and commonly assigned with the present application, claim the construction and arrangement of the combing wheel sheet feeder, and the construction and arrangement of the combing wheel, respectively, as disclosed herein.

BACKGROUND AND SUMMARY OF THE INVENTION

The use of combing wheel feed means to feed cut sheets to an open feed nip associated with a printer is well known; U.S. Pat. No. 640,368 is an example.

The problem of second sheet restraint, or restraint of the shingled sheets under the top sheet, has been addressed previously. For example, the above-mentioned U.S. Patent uses a hold-down device at the back of the sheet stack.

U.S. Pat. No. 868,317 suggests the use of a ramp and an air blast at the front of the stack to minimize multiple sheet feed, whereas U.S. Pat. No. 939,182 suggests the use of a ramp.

U.S. Pat. No. 1,986,558 suggests the use of a fulcrum foot, at the location of the combing wheel, which is lowered onto the stack as the combing wheel is raised.

As this prior art suggests, combing wheels are conventionally operable to shingle the leading edge of the top (or bottom) sheet of a stack into an open drive nip. The closing of this nip is operable to feed the sheet away from the stack, whereas the combing wheel is the means whereby only one sheet is staged into this open drive nip.

The present invention provides a unique drive nip closing member, constructed and arranged to inhibit second sheet feeding, and to preserve the shingled state of the second and its underlying sheets.

Specifically, the present invention's nip closing member includes a movable soft or resilient foam rubber pad which imprisons the leading edges of the second and its underlying sheets in a manner to prevent these sheets from moving in a sheet feeding direction with the top sheet (due to intersheet friction), and yet this pad does not push these sheets back toward the stack.

More specifically, the drive nip of the present invention is closed by a composite pad including a hard, low friction pad, and the above-mentioned foam rubber pad. The low friction material pushes the top sheet onto a continuously rotating feed roller, causing this sheet to be fed to the copier's transfer station. This low friction pressure pad is thicker than the upstream-located foam pad. Thus, a second-sheet-stop or step is formed. If the second sheet tends to feed with the top sheet, due to intersheet friction, it moves only so far as this step. In fact, sheets under the top sheet may not move at all due to the retarding effect of the soft foam pad. In any event, movement of these sheets, and specifically the sheet directly under the top sheet, is positively limited by the step. In like manner, the foam pad resists movement of all underlying sheets, due to intersheet friction.

As a further feature of the present invention, a spring biases the top sheet, and its underlying shingled sheets away from the feed roller, and specifically biases the leading edge of the second and its underlying sheets into the soft foam pad when the drive nip is closed.

INCORPORATION BY REFERENCE

The copier apparatus schematically shown in FIG. 1 is the IBM Series III Copier/Duplicator, and its Service Manual Form Number 241-5928-0, March 1976, are incorporated herein by reference.

The foregoing and other features and advantages of the invention will be apparent from the following more particular description of preferred embodiments of the invention, as illustrated in the accompanying drawings.

BRIEF DESCRIPTION OF THE DRAWINGS

FIGS. 3 and 4 are views of the deshingling mechanism associated with the paper feed assembly of FIG. 2;

FIG. 6 is a view of the left-hand end of the assembly of FIG. 2, showing the means for mounting this assembly to the copier, and showing the means for spring biasing the combing wheel away from the stack's top sheet, and for solenoid lowering this wheel onto the stack;

FIG. 8 is a top view of one of FIG. 7's feed nip lower pad assemblies, and showing the lower portion of the pneumatic sensor which senses the leading edge portion of a sheet which is staged into the normally open sheet drive nip;

FIG. 9 is a side view of the pneumatic sensor, partly in section;

(FIG. 1 is a schematic front view) of a portion of FIG. 1's copier frame, showing the four drive couplings (one for FIG. 1's bin 22, one for bin 23, and two for bin 36) which drive the copier's paper feed mechanism, and showing the belt drive therefor;

FIG. 16 is a view of the solenoid whose energization lowers the duplex tray's combing wheel down onto the paper in the duplex tray;

DESCRIPTION OF THE PREFERRED EMBODIMENT

Figure 1:
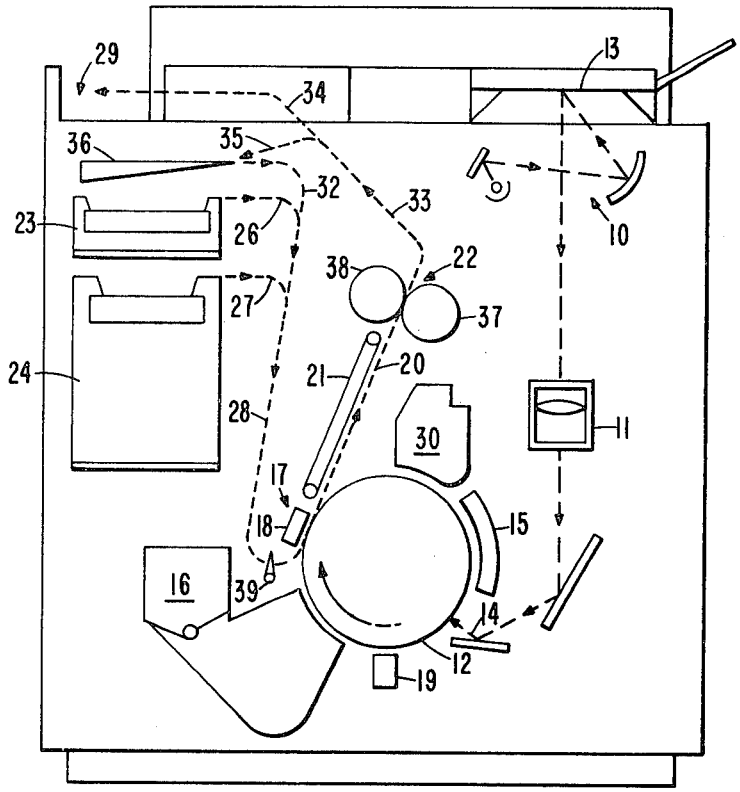
FIG. 1 is a schematic front view of a simplex/duplex mode electrophotographic copier incorporating the present invention.

FIG. 1 is a schematic view of a simplex/duplex mode xerographic copier incorporating the present invention, for example the IBM Series III Copier/Duplicator. In this device a scanning mirror system 10 and a moving lens 11 move in synchronism with the rotation of photoconductor drum 12 to place a latent image of stationary original document 13 onto the drum's surface. Drum 12 is constructed and arranged with two operative photoconductor panels on its circumference, so as to be capable of producing two copies for each drum revolution.

As is well known, prior to imaging at 14, the drum is charged by corona 15. Since only the photoconductor's working area, i.e. the area which will correspond to a sheet of copy paper at transfer station 17, need be charged, the photoconductor surrounding this working area is erased by erase station 19, for example by means described in the IBM TECHNICAL DISCLOSURE BULLETIN of November 1976, at pages 1983 and 1984.

After imaging, the drum's latent image is developed by magnetic brush developer 16. Thereafter the drum's toned visible image is transferred to a sheet of plain copy paper at transfer station 17 by operation of transfer corona 18. A Bernoulli sheet detach means, as shown in the IBM TECHNICAL DISCLOSURE BULLETIN of January 1973 and May 1973, at pages 2378 and 365, respectively, operates to cause the now-toned sheet to leave the surface of the drum and to follow sheet movement path 20, adjacent vacuum conveyor 21, on its way to hot roll fuser assembly 22. As the sheet moves through path 20, the sheet's straight leading edge is perpendicular to path 20. After fusing, the finished copy sheet follows sheet path 33, 34 and is deposited in output tray 29 when the copier is operating in the simplex mode, or side two in the duplex mode. When the copier is operating in the duplex mode, side one, the copy sheet follows sheet path 33, 35, and is deposited in duplex bin 36. Thereafter, when operating in the side-two duplex mode, these sheets return to the transfer station while following sheet path 32, 28.

After transfer, the drum is cleaned as it passes cleaning station 30.

The copier of FIG. 1 includes two copy sheet supply bins 23 and 24. Each supply bin includes a bidirectionally, vertically movable elevator which supports the stack. While this structure is well known to those of skill in the art, an exemplary structure is described in the IBM TECHNICAL DISCLOSURE BULLETIN of August 1974, at pages 670 and 671. Feed means, to be described, within the bin selected for use, is operable to feed the boundary sheet, i.e., the top sheet, of the stack to its sheet discharge path 26, 27, 32. This sheet is rear-edge-aligned as it travels down sheet path 28 to be momentarily stopped at paper registration gate 31. As the leading edge of the drum's toned image arrives in the vicinity of this gate, the gate is opened to allow the sheet to move into transfer station 17 with its leading edge in exact registry with the drum's image leading edge.

The construction of hot roll fuser assembly 22 will not be described in detail. Generally, hot roll 37 is heated to an accurately controlled temperature by an internal heater and an associated temperature control system, not shown. The hot roll preferably includes a deformable external surface formed as an elastomeric surface. This surface is designed to engage the toned side of the copy sheet, fuse the toner thereon, and readily release the sheet with a minimum adherence of residual toner to the hot roll. Such a hot roll is described, for example, in the IBM TECHNICAL DISCLOSURE BULLETIN of August 1973, at page 896.

Backup roll 38 is preferably a relatively cool and rigid roll. Rolls 37 and 38 are circular cylinders, such that the fusing nip formed thereby defines a line (of some width due to deformation of hot roll 37) parallel to the axis of rolls 37 and 38.

The fusing nip formed by rolls 37 and 38 may be closed and opened in synchronism with the arrival and departure of the copy sheet's leading and trailing edges, respectively. This synchronism is achieved by a drum position sensing means, not shown, which responds to the position of drum 12 and effects opening and closing of the nip by means of a copier logic control system, not shown. An exemplary mechanism for effecting the opening and closing of this nip is shown in the IBM TECHNICAL DISCLOSURE BULLETIN of May 1973, at page 3644. In the alternative, for a multicopy run, the fusing nip may remain continuously closed until the trailing end of the last sheet has passed therethrough.

The term copier control logic is intended to encompass the various means known to those of skill in the art. Generally known forms involve electronic processors, hard-wired logic circuits, electromechanical relays, and/or cam controlled switches or their equivalent. As is well known, the drum's changing position generates position signals which are then related to means such as a comparison of the number of copies requested to the number of times the original document has been scanned. So long as more copies are needed, latent images are formed on the photoconductor, and one sheet of paper is fed to the transfer station for each image.

Sheet supply bins 23 and 24 are constructed and arranged to adjustably hold cut sheets of transfer material of different sizes, for example legal and letter size paper, respectively. Sheets therein are oriented such that their narrow dimension is in the direction of paper feed 28. In addition, the sheets in each bin are stacked such that their rear narrow edge (which is parallel to the direction of paper feed 28) lies in a common vertical plane. Thus, if bin 23 contains legal size paper, its front narrow edge overlaps the front narrow edge of letter size paper in bin 24 by some three inches. As a sheet travels down sheet path 28 its long leading edge is presented to gate 28 and transfer station 17 such that this edge is substantially parallel to the axis of photoconductor drum 12.

Figure 2:
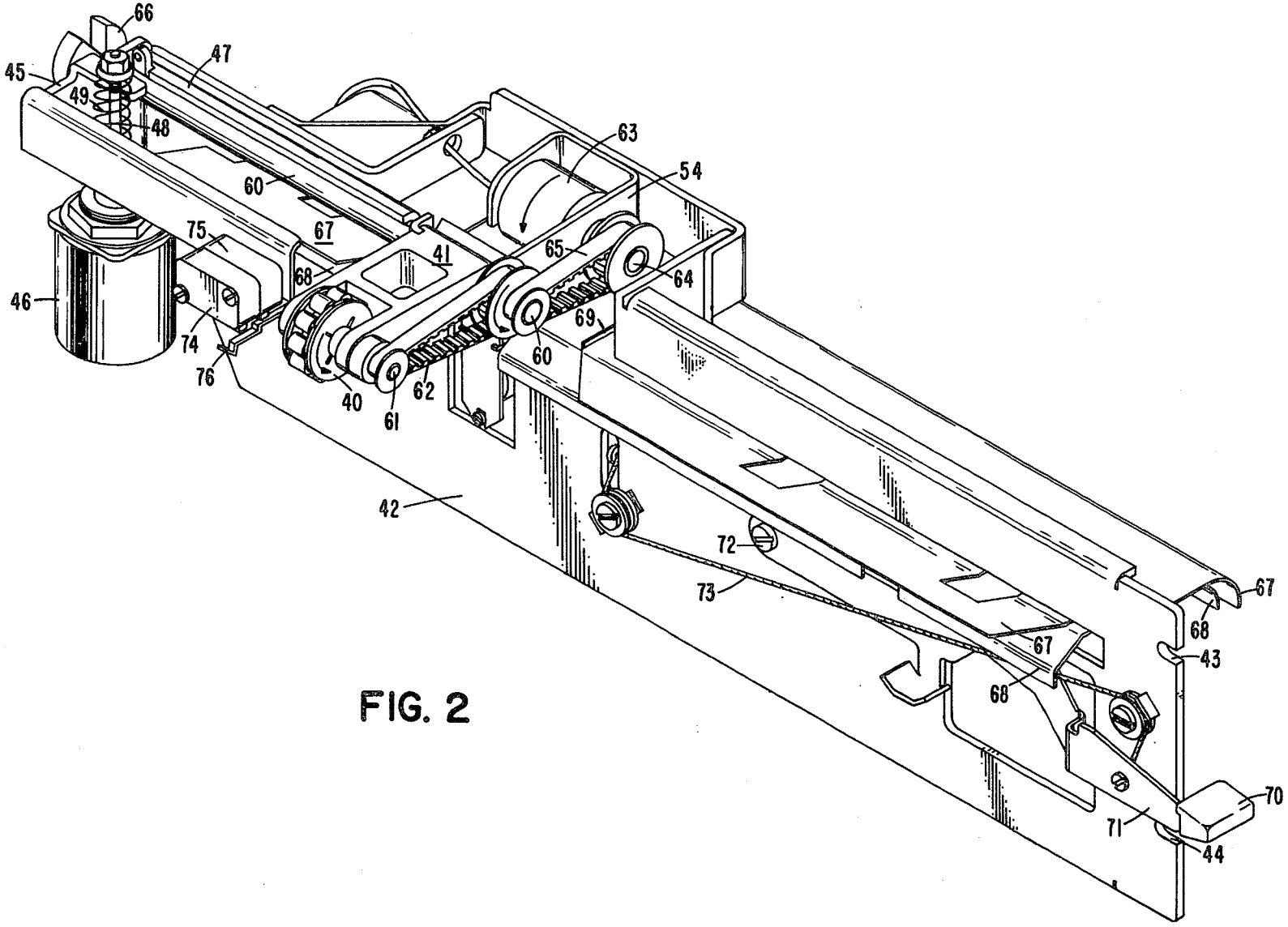
FIG. 2 is a perspective view of one of the two removable, unitary combing wheel paper feed assemblies used to feed cut sheets from the two copy sheet supply bins shown in FIG. 1, as seen from the side of the assembly facing the sheet stack.
Figure 5:
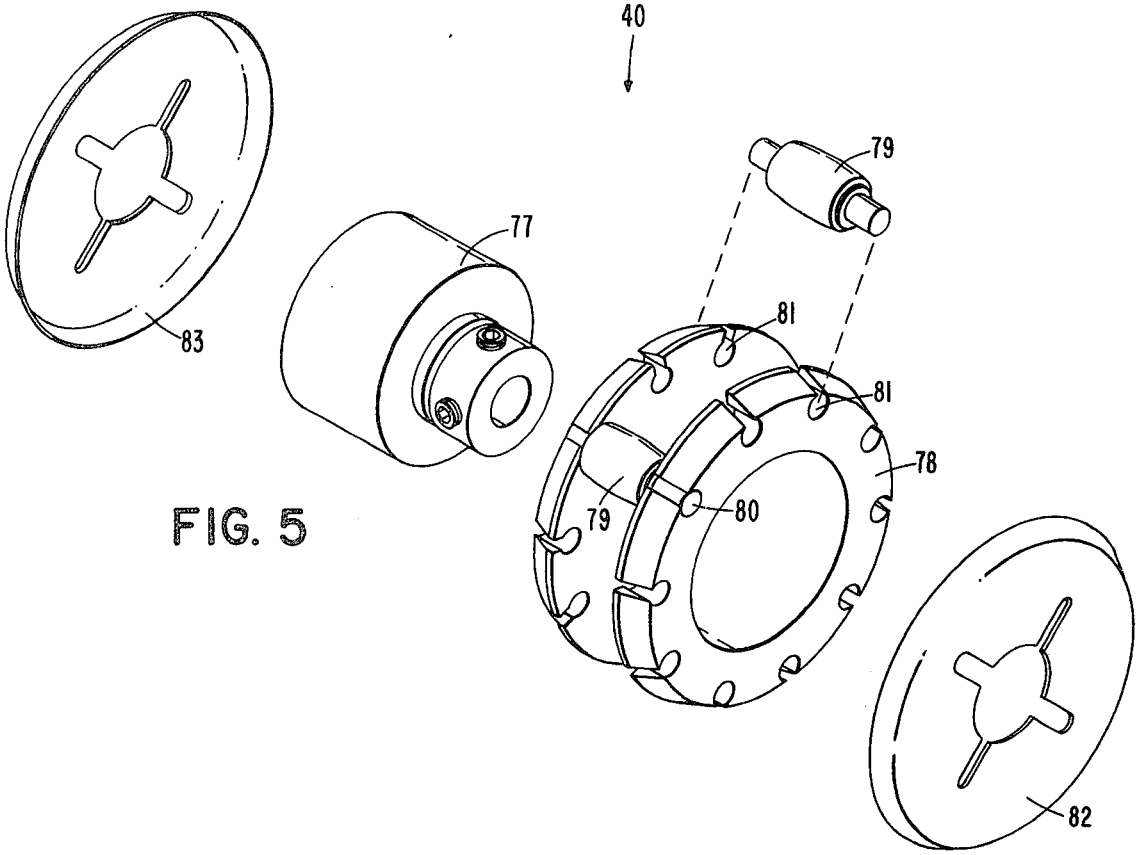
FIG. 5 is an exploded view showing the resilient construction of FIG. 2's combing wheel.

Each of FIG. 1's copy sheet supply bins or drawers 23 and 24 cooperates with a removable, unitary paper feed means as shown in FIG. 2, one such feed means being provided for each bin. The apparatus of FIG. 2 is adapted to serially feed cut sheets from the top of a paper stack to the copier's transfer station 17. Combing wheel 40, whose details of construction are shown in FIG. 5, is operable to cooperate with the top surface of the top sheet of the stack of sheets in bins 23 and 24. Combing wheel 40 constantly rotates in a counterclockwise direction, at a uniform speed of approximately 2600 rpm. Generically, a peripheral velocity of approximately 75 to 250 inches per second is preferred. Wheel 40 is approximately one and one-eighth inches in diameter, and one-half inch in axial thickness. A pivoted arm 41 mounts the combing wheel to a plate-like mounting frame 42. This mounting frame is the central structure to which all other components of FIG. 2's paper feed apparatus are attached, and is the means by which the FIG. 2 assembly is removably mounted to the copier of FIG. 1. This mounting means comprises two mounting notches 43 and 44 which are adapted to receive screw fasteners to mount the plate in a vertical attitude within the copier. At the other end mounting plate 42 is bent 90° to form an extension 45. This extension contains two holes 51 and 52, FIG. 6, one of which is adapted to receive a screw fastener and the other of which is adapted to receive a positioning post formed as part of the copier's frame.

Figure 15:
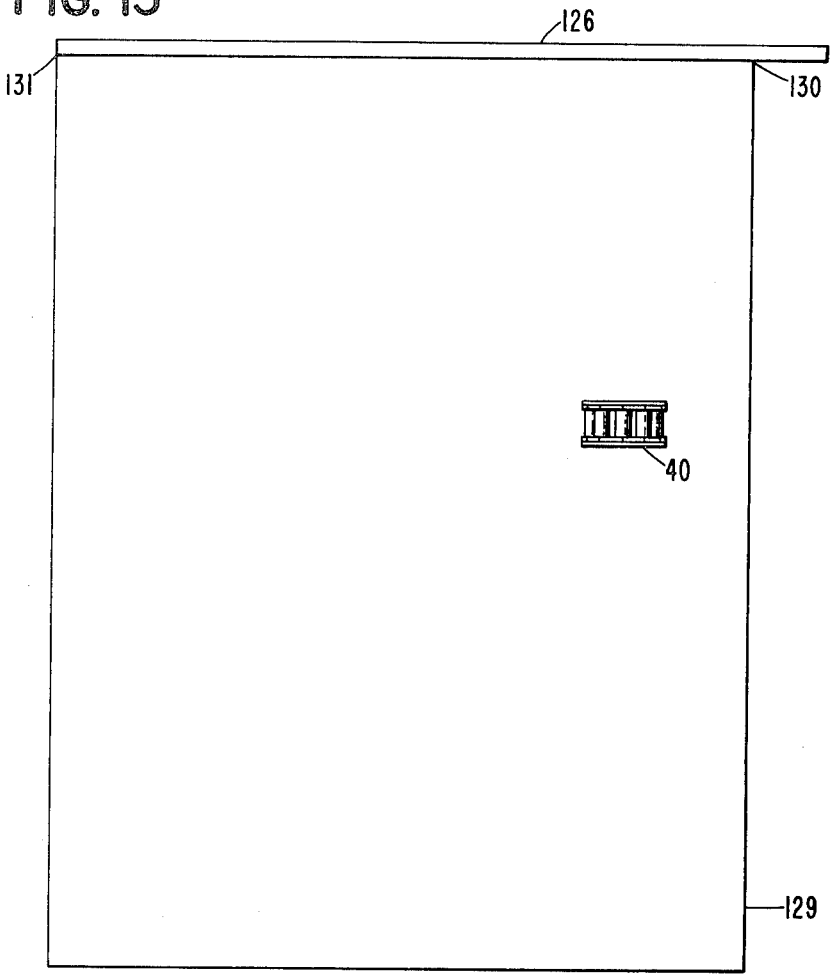
FIG. 15 is a top view of a letter size sheet of paper in FIG. 14's duplex tray, showing the placement position of the combing wheel, and the relationship of the duplex bin's ribbed rear vertical wall.

While the location of the combing wheel on the sheet stack is not critical, it has been found to operate satisfactorily when it is located approximately two inches from the sheet's leading edge, and approximately four and one-half inches from its rear side edge, see FIG. 15. The four and one-half inch dimension is selected to insure that the combing wheel is located to the rear (i.e. the copier's back wall) of the center of the shortest paper to be fed. Thus, operation of the combing wheel tends to rotate the sheet slightly in a clockwise direction (viewed from above), to thereby move its leading edge rear corner outward away from mechanisms which might obstruct sheet feed.

This slight rotation has the effect of moving the sheet's trailing edge corner back toward the bin's rear wall. Thus, it is desirable to provide, in all three bins 23, 24 and 36, means to overhang at least this trailing edge corner, to prevent this corner of the shingled sheets from climbing up the rear side of the bin, as will be explained relative to FIG. 15.

FIG. 2 shows combing wheel 40 in its elevated position, wherein it is out of contact with the top sheet. Solenoid 46 is mounted on frame 42 and is coupled to a pivoting beam 47 by way of solenoid armature pin 48 and spring 49, the latter comprising a strain relief coupling. Solenoid 46, when energized, is operable to pivot beam 47 and arm 41 in a counterclockwise direction about shaft 60, thus lowering combing wheel 40 down onto the stack.

Combing wheel support arm 41 is resiliently biased for rotation in a clockwise direction, up against a mechanical stop, as shown in FIG. 6.

With reference to FIG. 6, beam 47 is bearing-supported on shaft 60, and includes a 90° extension 85. The left-hand end of extension 85 is captured between nut 86 and the lower end of compression spring 49. Extension 85 carries a pin 87 which is coupled to the lower end of a tension spring 88. The upper end of this spring is attached to frame 42 at tab 89. Tab 89 also receives stop bolt 90, this stop bolt being adjustable to set the raised position of combing wheel 40. Energization of solenoid 46 causes its armature pin 48 to move downward. This downward movement results in counterclockwise rotation of beam 47, lowering the combing wheel onto the stack and loading lifting spring 88 and strain relief spring 49. Subsequent deenergization of solenoid 46 allows the mechanism to return to its FIG. 6 position by virtue of the energy stored in spring 88. The combing wheel is now out of contact with the stack's top sheet.

By way of example, combing wheels 40 resident in bins 23 and 24 resiliently engage the top sheet of the stack therein with a force of approximately 450 grams, whereas the combing wheel in duplex bin 36 engages the top sheet of the stack therein with a force of approximately 150 grams when 100 sheets reside in the duplex bin, and approximately 550 grams when one sheet is in the duplex bin, generically a range of from 100 to 600 grams is preferred. Too low a force produces slow shingling. Too high a force produces paper marking or damage.

Figure 7:
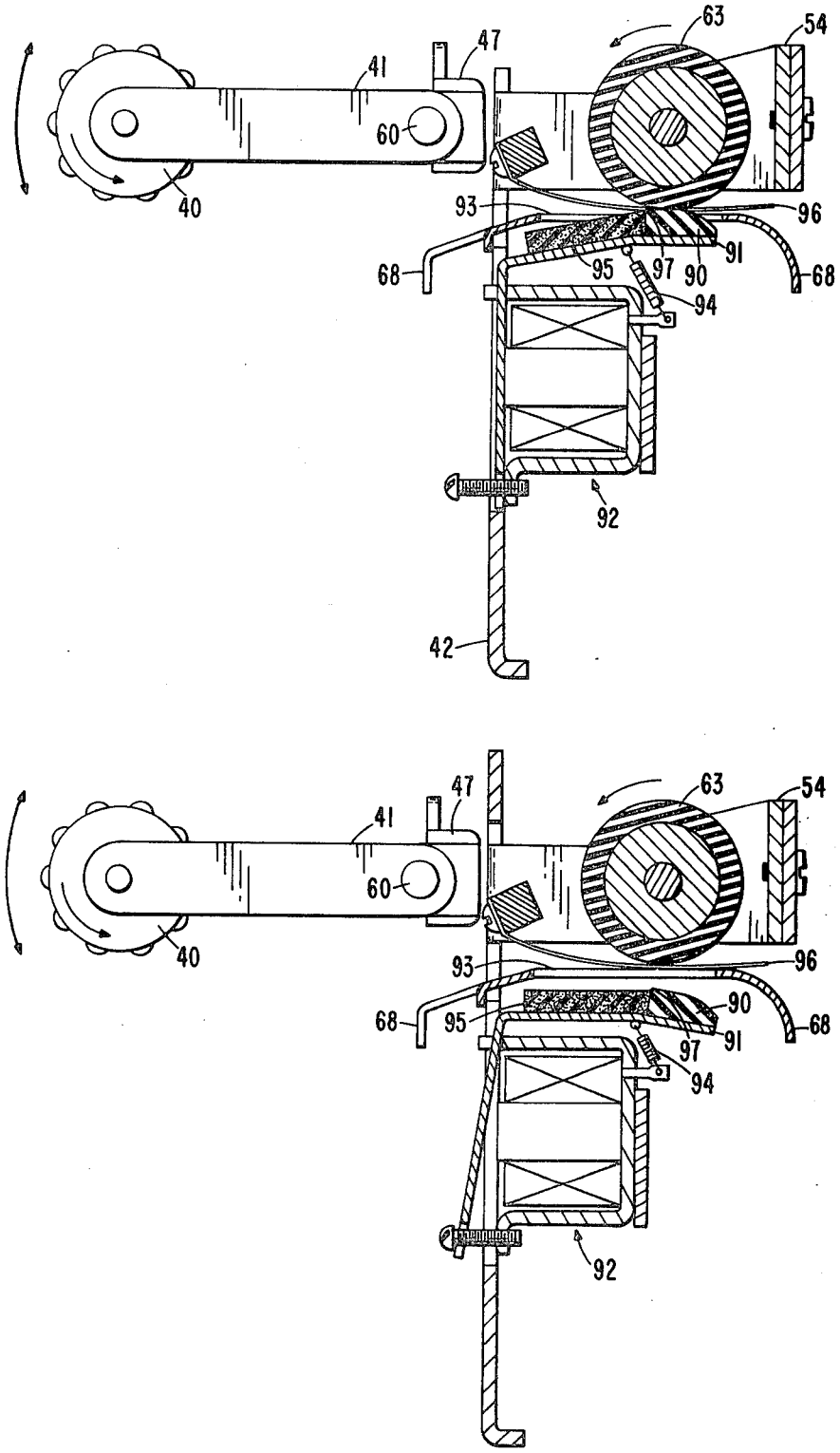
FIG. 7 is a view which shows the one-above-the-other orientation of the two individually removable, unitary combing wheel paper feed assemblies used to feed cut sheets from the two copy sheet supply bins shown in FIG. 1, wherein each assembly is sectioned to show the sheet drive nip of the present invention, formed by the upper friction feed roller and the lower movable pad, wherein the upper sheet drive nip is closed, and the lower sheet drive nip is open.

Drive shaft 60 is rotationally mounted at a fixed position on mounting plate 42. Shaft 60 lies in a horizontal plane when the apparatus of FIG. 2 is mounted within the copier. This shaft is continuously coupled to combing wheel shaft 61 by way of timing belt 62. Friction feed roller 63 is spaced from combing wheel 40 in the direction of sheet feed and is adapted to cooperate with the top surface of the top sheet in the stack, when this sheet has been shingled such that its leading edge portion occupies the open nip formed by friction feed roller 63 and a pivoted pressure pad, also mounted on mounting frame member 42 below feed roller 63, as shown in FIG. 7. The friction feed roller's shaft 64 is coupled to shaft 60 by way of timing belt 65, and is mounted to frame 42 by way of U-shaped bracket 54. Thus, combing wheel 40 and feed roller 63 continuously rotate in a counterclockwise direction with counterclockwise rotation of shaft 60.

Shaft 60 is adapted to be continuously connected to the copier's pin drive coupling, (112 or 113 of FIG. 13) mounted on frame 110 of the copier, by way of a mating notch coupling 66. As shown, the rotational axis of the combing wheel and the feed roller are parallel to drive shaft 60.

Upper and lower sheet guide plates or members 67 and 68 are mounted to frame member 42 and define a converging sheet transport channel, located between combing wheel 40 and drive roller 63, into which the sheets are shingled. The exit channel formed by the parallel portion of sheet guides 67 and 68 comprise FIG. 1's sheet path portions 26 and 27.

Figure 3:
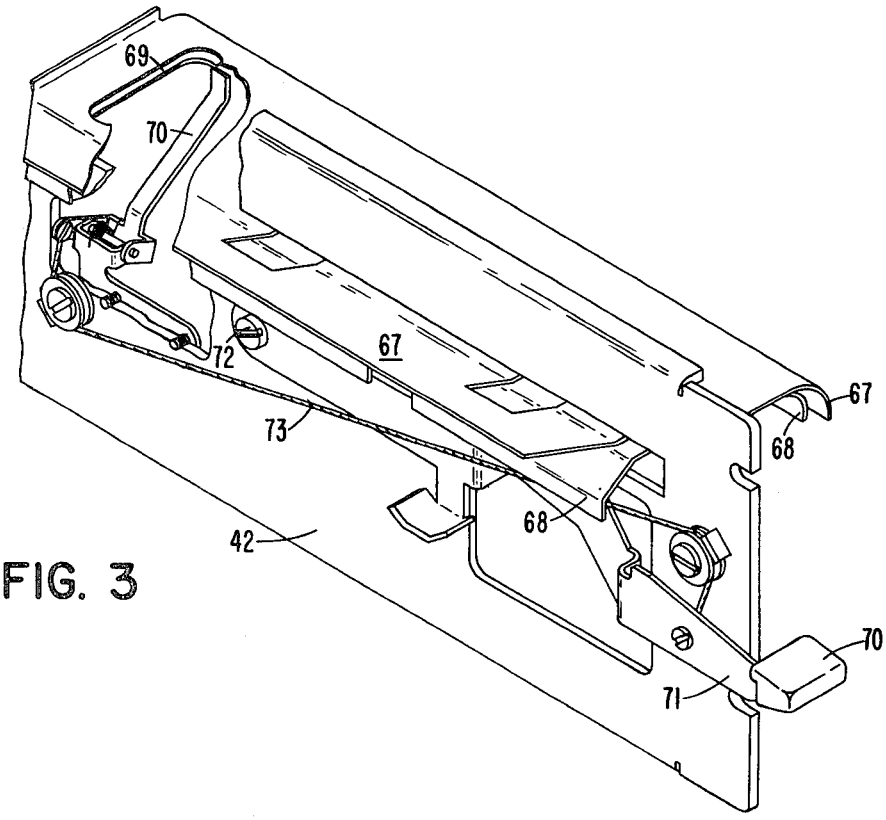

As more completely shown in FIG. 3, each of the sheet guides 67 and 68 includes an aligned, elongated opening 69 which is adapted to cooperate with a deshingling means comprising a pivoted arm 70. Arm 70 is mounted to frame member 42 and is spring biased in a clockwise direction, out of the paper feed channel defined by guides 67 and 68.

When the operator desires to reload paper within either of the paper supply bins 23 or 24, manual knob 70 is pushed downward, causing lever 71 to pivot clockwise about its pivotal attachment 72 to mounting plate 42. This movement of lever 71 controls a paper stack elevator, more completely described in the referenced service manual, to lower the elevator to a loading position. Once the elevator has reached its loading position, the associated paper supply bin 23 is manually pulled horizontally out of the front of the copier for operator access, such as reloading the paper stack.

Movement of lever 71 to its down position pulls cable 73, causing this cable to rotate FIG. 3's deshingling arm 70 in a counterclockwise direction, to the full-line position shown in FIG. 4. Movement of arm 70 from the FIG. 3 to the FIG. 4 position is operable to deshingle the top sheets of the stack, as the result of a command indicative of the fact that the copier's paper supply drawer is to be open, as for paper reloading. The extent of deshingling accomplished by arm 70 is a matter of choice. It has been found that the deshingling achieved by movement shown in FIG. 4 is sufficient since subsequent lowering of the paper supply elevator operates to scrub the top shingled sheets of the stack across the portion 84 sheet guide 68, and to thus further deshingle the stack as the paper supply elevator lowers.

The vertical height of the top sheet of the stack, within paper supply bins 23 and 24, is sensed by a pair of switches 74 and 75 (FIG. 2), as these switches are controlled by an arm 76 which rests on the top sheet of the stack. Arm 76 has two stepped portions, the first of which controls switch 75 and the second of which controls switch 74.

Switch 75 is a normally closed switch and operates to raise the paper stack support elevator until arm 76 engages the top sheet to stop raising of the elevator. Switch 74 is a normally open switch. If the paper stack should swell, as may be caused for example by high humidity, switch 74 closes to cause the stack support elevator to lower until switch 74 has opened.

Combing wheel 40 is constructed and arranged such that its sheet engaging rollers are supported by a resilient member. With this construction, acoustical noise in a convenience copier environment, such as a business office, is minimized, repeatable, reliable shingling is enhanced, and marking or polishing of the paper is minimized. With reference to FIG. 5, combing wheel 40 is supported on its shaft 62 by way of a rigid, metallic hub 77. This hub securely fits within a generally doughnut shaped rubber wheel 78 having an annular cavity containing a plurality of sheet engaging rollers 79. Rubber wheel 78 is of a durometer in the range of 40 to 80. Too low a durometer may cause the wheel's flanges, rather than its rollers, to hit the paper. Too high a durometer increases both the acoustical noise and the force variations with which the rollers strike the paper. These rollers are constructed of a hard, low friction material, such as metal or plastic, and are rotationally and substantially frictionless supported on a metal shaft 80. The opposite ends of each shaft 80 are pressed into radially extending positioning slots 81 formed about the two spaced, resilient walls defining the annular cavity occupied by rollers 79. Once all rollers are assembled on member 78, the assembly is completed by a pair of metal end caps 82 and 83. These end caps do not physically engage axles 80, but allow radial movement of each axle with respect to the combing wheel shaft 61, such that the combing wheel exhibits a resilient construction. Each end cap includes an annular inturned rib which overhangs the ends of axles 80, thus imprisoning the axles. This construction and arrangement allows each of the rollers 79 to conform to the planar top surface of the paper, rather than rebounding off the paper and then settling back down onto the paper, in rapid oscillatory fashion. The lack of such vibration operates to reduce acoustical noise and improves the shingling phenomenon. Pins 80 are effectively isolated from hub 77 by the use of resilient rubber-like member 78. This rubber material exhibits a spring rate and damping factor, and deforms under load allowing each roller to remain in contact with the top sheet of paper for a longer period of time than would occur in a nonresilient construction. In addition the force magnitude excursions are minimized. The resilient rubber-like material of member 78 serves as a spring-damper and dampens the wheel's force function, allowing the roller to remain in contact with the paper, rather than rebounding and settling down on the paper in an oscillatory fashion. The forming of slots 51 in member 78 facilitates ease of assembly, either manual or machine assembly.

Figure 10:
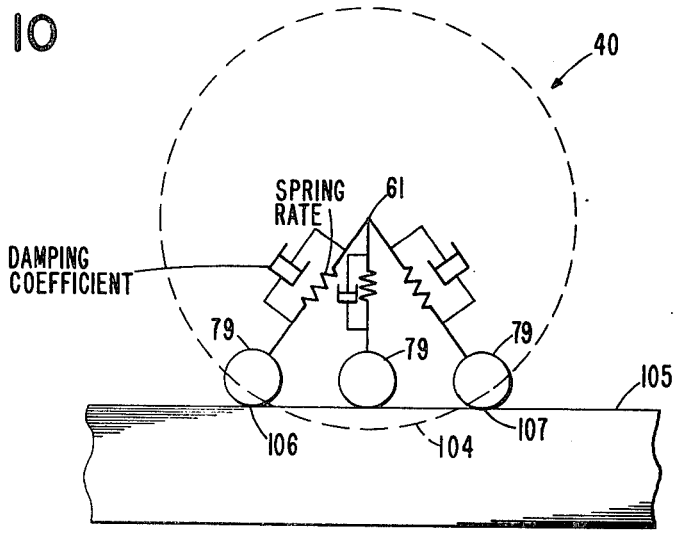
FIG. 10 is a generic representation of FIG. 5's combing wheel, showing the resilient wheel as having each roller supported by a spring rate and a damping coefficient.

While a preferred combing wheel construction has been shown in detail, generically such a wheel is as represented in FIG. 10. Each roller thereof is generically supported by mechanical means having a spring rate and a damping coefficient. The spring rate and damping coefficient insure that each individual roller is capable of deflecting radially inward toward rotational axis 61, from its circular path 104, as it continuously engages sheet stack 105 during its period of intermittent engagement 106 to 107, with a force profile having minimized force variation excursions.

Figure 11:
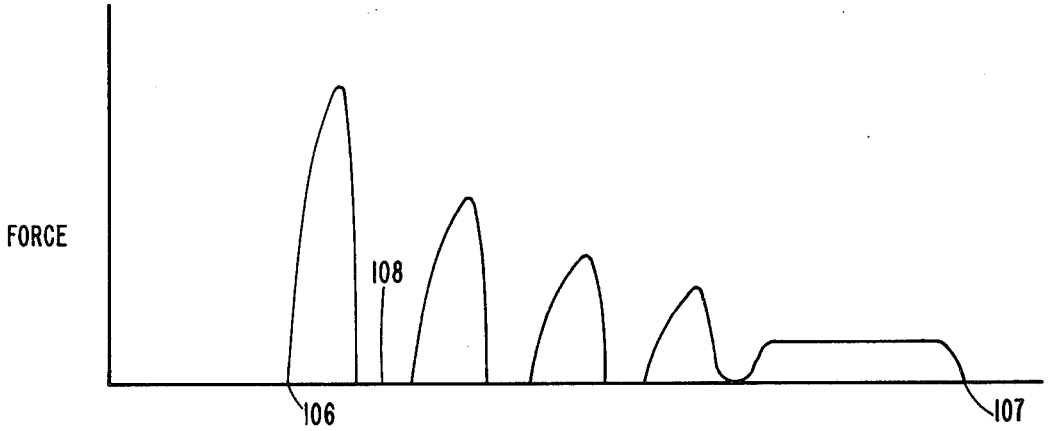
FIG. 11 PRIOR ART
FIG. 11 is a force-vs-distance plot for a single roller contact for a nonresilient combing wheel.
Figure 12:
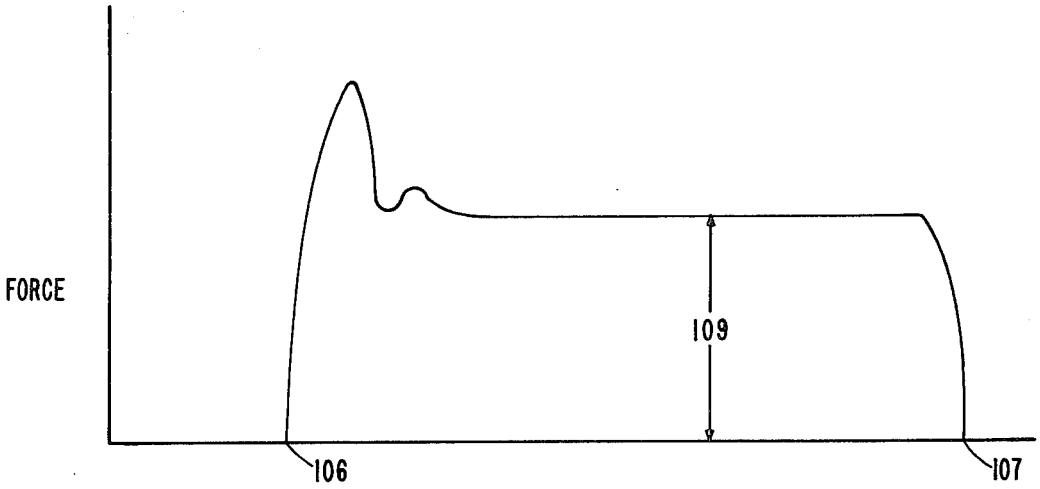
FIG. 12 is a force-vs-distance plot for a single roller contact for the resilient combing wheel disclosed herein.

FIGS. 11 and 12 are a graphic comparison of a prior art rigid combing wheel with the present invention's resilient combing wheel. As shown in FIG. 11, the force variation experienced by the paper not only has wide excursions, but falls to zero, as at 108 when the combing wheel bounces off the paper. In FIG. 12, while some force profile variation may occur on initial contact between the roller and the paper, the roller does not leave the paper and a steady state shingling force 109 is quickly established.

As has been mentioned, combing wheel 40 is operable to maintain the top sheet of the stack such that the leading edge portion of this top sheet is staged within the normally open sheet drive nip formed by friction feed roller 63 and an underlying pivoted pressure pad 90, shown in FIG. 7. Pad 90 is a relatively hard, low friction material, for example polycarbonate. The coefficient of friction of feed roller 63 is selected to be higher than that of pad 90, such that a single sheet of paper within the nip 63, 90, will be fed in a forward direction (to the right as shown in FIG. 7) under the driving action of roller 63.

Pad 90 is supported by a metallic ramp-like armature 91 of solenoid 92, this solenoid being controlled in a well known manner by the copier's logic, to be energized, and thus feed a sheet to the copier's transfer station, upon copier logic command. The upper sheet feeding assembly of FIG. 7 is shown with its solenoid 92 energized, whereas the lower solenoid 92 is deenergized.

Also seen in FIG. 7, an opening 93 is formed in lower sheet guide 68, to accommodate upward movement of composite pad of the present invention, including pads 90 and 95. Spring 94 biases the composite 90, 95 to its retracted position, out of opening 93.

As is well known in the art of combing wheel sheet feeders, the leading edge of a number of the stack's top sheets will be staged forward in shingled fashion, and in the sheet feeding direction, for a distance encompassed by the open nip 63, 90, and an upstream located resilient sponge rubber pad 95. The shingled attitude of perhaps the stack's top five sheets is such that the leading edge portion of the one top sheet is positioned in nip 63, 90, whereas the remaining four underlying sheets have their leading edges staged in shingled fashion in the zone encompassed by soft sponge rubber pad 95.

With reference to FIGS. 7 and 8, the shingled sheets in the area of nip 63, pad 90 and pad 95 are pushed down against sheet guide 68 by U-shaped spring 96 of the present invention. When the nip is closed, this spring forces the leading edge of the second and other underlying sheets into the resilient surface of pad 95, such that these sheets tend to be retained in their shingled attitude. As the top sheet is fed away to the right, by operation of roller 63, the friction between this top sheet and the second sheet may be such that the leading edge of the second sheet moves into the step 97 formed by polycarbonate pad 90 and thinner sponge rubber pad 95. In accordance with the present invention, step 97 is intentionally formed by providing pad 90 with a greater thickness than pad 95, thus leaving a step of approximately 0.025 inch. Step 97 is a positive restraint to prevent feeding of the second sheet into nip 63, 90. Once the second sheet has moved into step 97 this sheet stops (assuming that the second sheet has moved to the right with the top sheet) due to intersheet friction. There is then no possibility that the sheets underlying the second sheet will likewise be frictionally moved forward, away from their proper shingled position. Thus, step 97 acts as a positive second sheet restraint, should the restraining effect of resilient pad 95 be unable to retain the second sheet in its normal shingled state. An example of a particularly difficult sheet-to-sheet interface through which to feed paper is the "ream seam" formed when a new ream of paper is placed upon sheets already in a stack.

When composite pad 90, 95 is in its nip-open position, it is retracted out of the sheet-shingling plane defined by sheet guide 68. Thus, the composite pad cannot disturb the shingling action to be achieved by its combing wheel 40, as the leading edges of these sheets are supported by, and slide freely on, sheet guide 68.

When composite pad 90, 95 is in its nip-closed position, soft pad 95 defines a ramp inclined upward toward the nip formed by low friction pad 90 and the drive roller.

FIG. 8 shows more clearly the dimensions of pads 90 and 95. By way of example, pad 90 is 1.10 inches wide, and pad 95 is 0.50 inch wide, measured in a direction parallel to the feed roller's axis 64 (FIG. 2).

FIG. 8 also shows the blowing air jet member 98 of a pneumatic sheet sensor couple 98, 99 (FIG. 9). As seen in FIG. 9, air issuing upward through space 100 enters member 99 to increase the pressure in pneumatic-to-electric transducer 101. The presence or absence of a sheet in space 100, i.e. the leading edge of the stack's top sheet, operates to control an electrical switching circuit whose output comprises terminals 102 and 103. As above mentioned, these terminals are connected to a power supply (not shown) to effect energization of solenoid 46 (FIGS. 2 and 6), to thereby raise its associated combing wheel 40 in the presence of a sheet in space 100.

Figure 13:
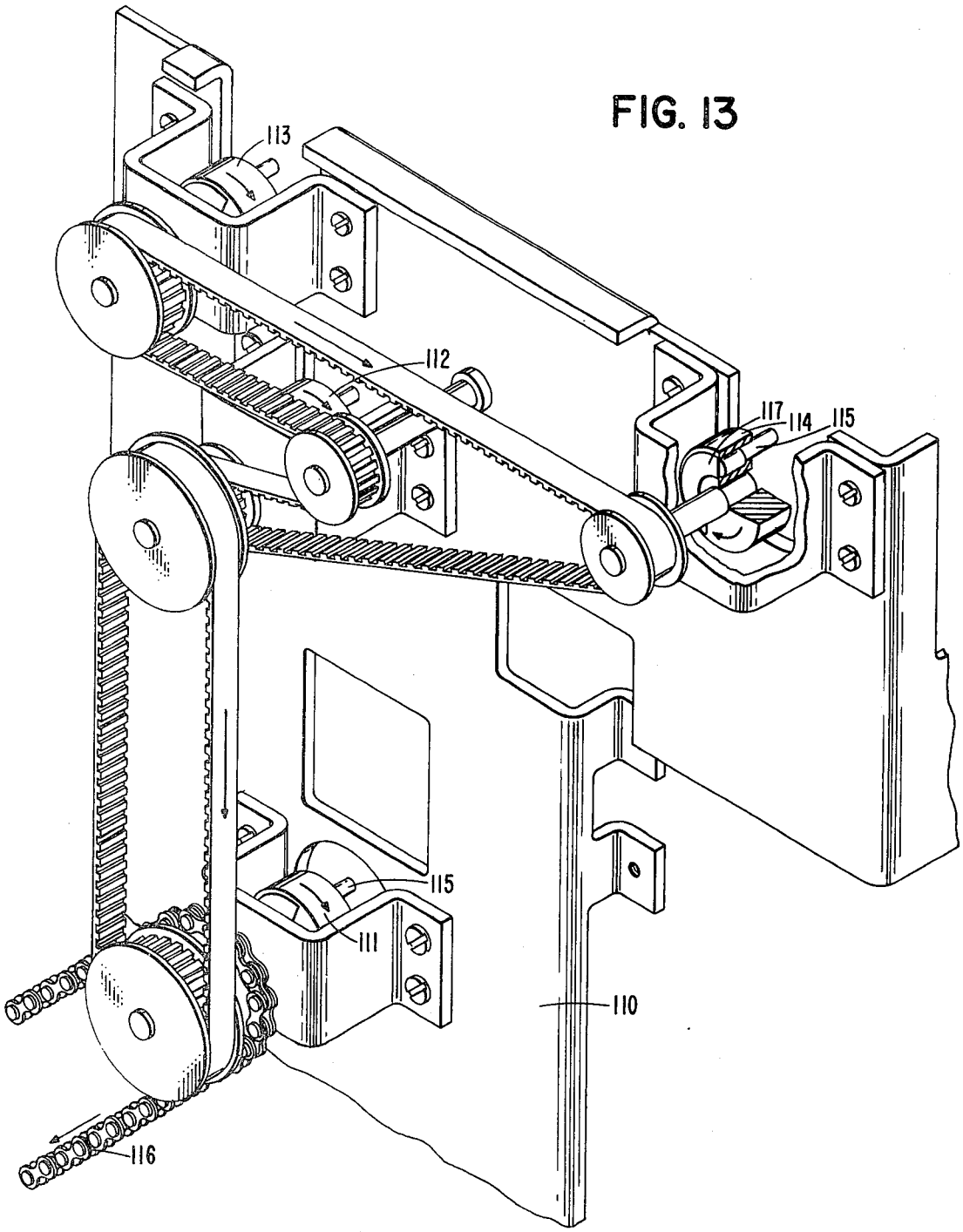
FIG. 13 is a back view

As has been mentioned, the combing wheel feed means associated with each of FIG. 1's bins 23, 24 and 36 is supported from the main frame of the copier. FIG. 13 shows a portion 110 of this main frame. FIG. 13 is a back view, noting that FIG. 1 is a front view of the copier. Frame 110 supports four drive couplings 111, 112, 113 and 114. Each of these couplings includes a drive pin 115 adapted to be engaged in the notch formed in its coupling 66, shown in FIG. 2. Motive power is provided by continuously moving chain 116, this chain moving in the direction indicated by FIG. 13's arrow. As a result, rotation of the various drive couplings is in the direction shown. Each drive coupling's pin 115 is slidably mounted and is biased toward the front of the copier by an anchored C-shaped spring 117. While not shown in FIG. 13, frame member 110 includes positioning pins and/or bolt receiving holes cooperating with mounting means such as 51 and 52 of FIG. 6.

Figure 14:
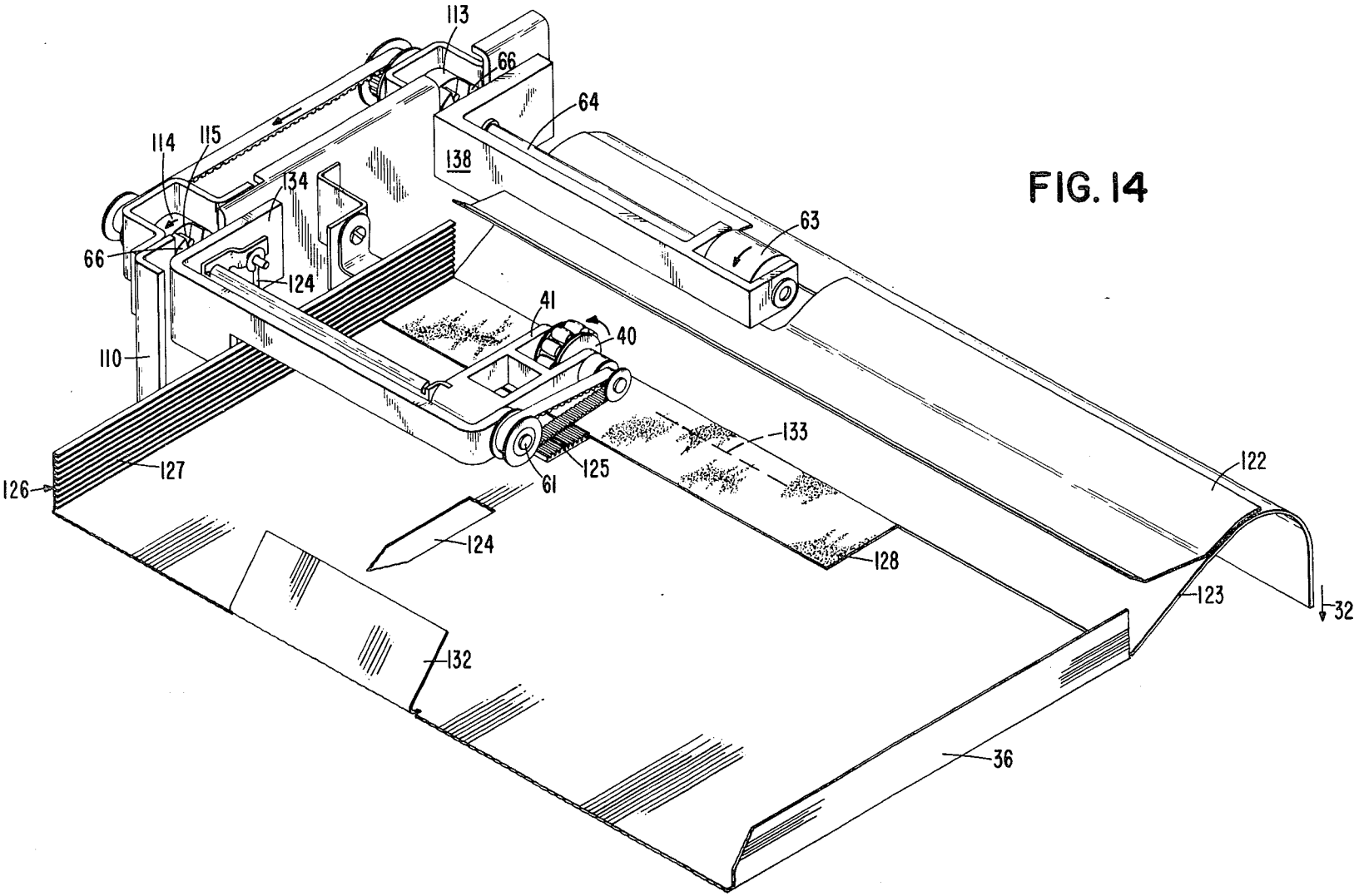
FIG. 14 is a partial front view of FIG. 13's copier frame, showing FIG. 1's duplex tray attached thereto, and showing the duplex tray's combing wheel, bottom-of-the-bin pad, and closable drive nip with its cooperating sheet guides.

FIG. 14 is a partial front view of FIG. 13's copier frame 110, showing FIG. 1's duplex tray 36 attached thereto. Arrow 32 relates the sheet's exit path from the duplex tray to that shown in FIG. 1.

Combing wheel 40 and drive roller 63 of FIG. 14 are not incorporated into one unitary assembly, as are the corresponding means of paper supply bins 23 and 24, as shown in FIG. 2. Rather, the corresponding paper drive means for duplex bin 36 is each provided with its own drive coupling 113, 114 cooperating with its mating drive coupling 66. Thus, continuous counterclockwise rotation of combing wheel 40 and drive roller 63 is achieved. Combing wheel 40 is spring biased to an elevated position and is moved down onto the top sheet of the stack of sheets within duplex bin 36 by energization of a solenoid 120 (see FIG. 16) connected to link 121. Drive roller 63 is mounted at a fixed position, such that its lower surface penetrates the sheet guide channel formed by upper sheet guide 122 and lower sheet guide 123.

The construction of the duplex bin's combing wheel and drive roller assemblies is necessitated by virtue of FIG. 1's sheet path 35. As is well known, FIG. 1's alternate sheet paths 34 and 35 are implemented by a pivoting exit vane, not shown. When this exit vane is in a down position, side-one copied sheets of a duplex copy run are inserted into FIG. 14's duplex tray 36, as the leading edge of these sheets pass over the top of roller 63 (by virtue of sheet guides not shown), and down below combing wheel 40, coming to rest with the sheet's leading edge adjacent the duplex tray's inclined stop member 132. In this position, the sheet's rear edge is in the general vicinity of the duplex bin's rear wall 126, and its trailing edge (this will be the leading edge when paper exits the duplex tray on its way to side-two copying) resides as generally shown by broken line 133 of FIG. 14.

Nonetheless, the duplex bin's combing wheel assembly is removable as a unitary assembly, and its drive roller assembly, including sheet guides 122 and 123, are removable as a unitary assembly.

Duplex bin 36 is of the type disclosed in the above-mentioned service manual, and includes, among other things, an opening 124 which is adapted to cooperate with a sensor indicating the presence or absence of paper in the duplex bin. The duplex bin disclosed herein differs from that described in the above-mentioned service manual in two material aspects. Namely, a bottom-of-the-bin pad 125 cooperates with combing wheel 40, and the rear surface of the duplex bin includes a corrugated-like structure 126 having projecting ribs 127 of progressively increasing length, from the bottom to the top of the bin.

Figure 17:
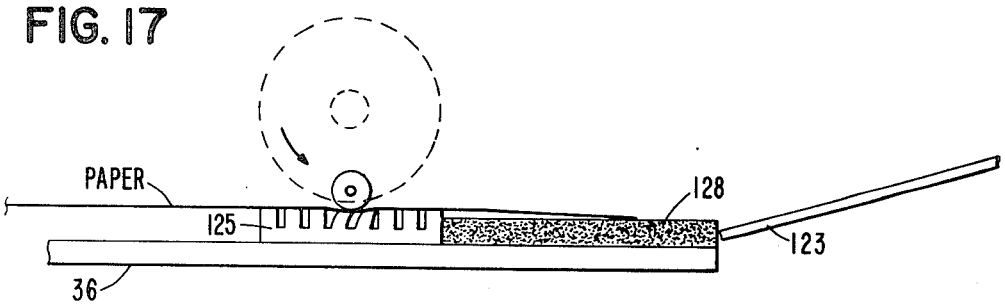
FIG. 17 is a side view of the portion of the duplex bin which includes the bin's bottom-of-the-bin pad.

As shown in FIG. 17, pad 25 is fixed to the bottom of duplex bin 36 and its upper surface resides at a higher elevation than the upper surface of foam rubber pad 128. When combing wheel 40 is forcibly lowered onto the paper sheets then resident in duplex bin 36, rotation of combing wheel 40 causes the corrugations in the upper surface of rubber pad 125 to deform in the direction of sheet feed. Generically, resilient pad 125 is movable in the direction of sheet shingling, so as to simulate the presence of a sheet underlying the bottommost sheet in duplex bin 36, thereby enabling combing wheel 40 to reliably shingle the stack's bottom sheet to drive roller 63.

Bins 23 and 24 are provided with a similar pad 25. By way of example, pads 25 are formed of solid rubber, of durometer 80 to 90. They are 0.12 inch thick, and are 0.66 inch long (measured in the direction of paper feed), and 0.40 inch wide. The cuts therein, which form the ribs, are 0.015 inch wide and 0.070 inch deep.

Figure 19:
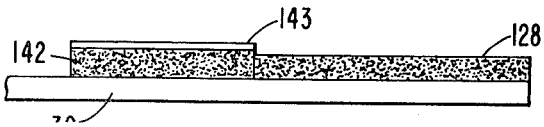
FIG. 19 is a side view of an alternate bottom-of-the-bin pad.

FIG. 19 shows an alternative structure for FIG. 17's bottom-of-the-bin pad. In the FIG. 19 construction, resilient pad 142 takes the form of foam rubber, whose upper surface is covered by a thin film of low friction material 143, for example, PTFE film. As noted herein, the combing wheel for duplex bin 36 engages the paper therein with increasing force as the number of sheets in the bin decreases. It has been found that the bottom-of-the-bin pad of FIG. 19 reliably accommodates this varying force.

As shown in FIG. 15, combing wheel 40 is situated forward of, and to the rear of, the center of gravity of the smallest sheet 129 which may reside in duplex tray 36. As a result of this construction and arrangement, the sheet tends to rotate slightly in a clockwise direction, as seen in the top view of FIG. 15, thus causing the sheet's forward corner 130 to pull away from the duplex tray's back wall 126, while the sheet's rear corner 131 tends to be forced into the rear wall. The function of FIG. 14's tongues, projections or ribs 127 is to prevent the sheet's rear corner 131 from climbing up the surface of wall 126, as sheet 129 and its underlying sheets (if any) are shingled forward by operation of combing wheel 40.

Bins 23 and 24 of FIG. 1 are constructed and arranged to include a similar overhanging rib to that of duplex bins member 127, to perform a similar function as the top sheets resident in bins 23 and 24 are shingled forward by operation of their corresponding combing wheel 40.

As seen in FIGS. 14 and 16, the duplex bin's combing wheel assembly includes a flange 134 by which the assembly is mounted to the copier's frame member 110. Solenoid 120 is mounted to flange 134. Spring 135 force biases the duplex bin's combing wheel 40 off paper therein. Energization of solenoid 120 draws link 121 down, forcing the combing wheel onto the paper in the duplex tray.

Figure 18:
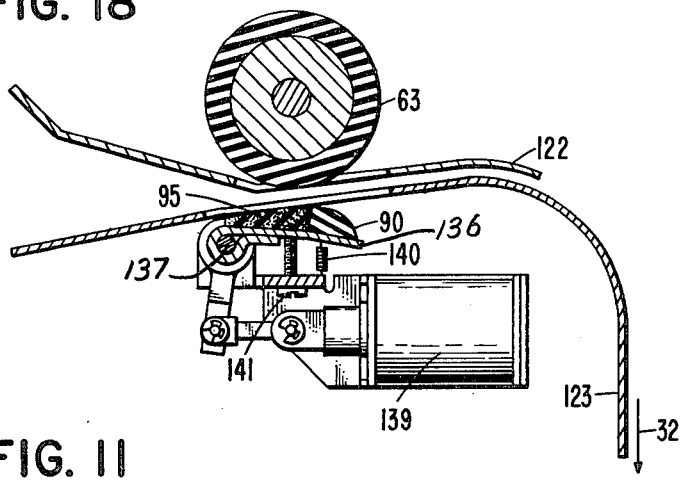
FIG. 18 is a view similar to FIG. 7, showing the nip closing member of the present invention as used in the duplex bin.

FIG. 18 discloses another embodiment of the present invention in the form of the nip closing member for FIG. 14's duplex bin, i.e. the movable composite pad underlying the duplex bin's feed roller 63. Again, composite pad 90, 95 is mounted to a metal plate 136 which is pivoted at fixed-position pivot 137. Pivot 137 is mounted to FIG. 14's feed roller frame 138, as are all nip closing components, including guides 122 and 123, and solenoid 139.

Plate 136 is spring biased, by spring 140, to abut adjustable stop 141. Solenoid 139 operates as do solenoids 92 of FIG. 7. That is, solenoid 139 is energized by copier logic upon a need to feed a side-one-copied sheet out of FIG. 14's duplex bin 36 to FIG. 1's transfer station 17, for second-side-copying. The composite pad of FIG. 18 is identical in concept to that of FIGS. 7 and 8.

While the invention has been particularly shown and described with reference to preferred embodiments thereof, it will be understood by those skilled in the art that various changes in form and details may be made therein without departing from the spirit and scope of the invention.

What is claimed is:

1. Sheet restraint means for use with a closable drive nip adapted to receive the leading edge of sheets which are shingled thereto by operation of a combing wheel, comprising:

a drive roller operable to feed the foremost shingled sheet in a given direction downstream of said roller;

a nip closing member spaced from said drive roller to define a drive nip;

means operable to produce relative movement between said drive roller and said nip closing member to effect closing of said drive nip;

a low friction, drive-roller-engaging member mounted on said nip closing member and cooperating with said drive roller to physically push the leading edge of the foremost shingled sheet against said drive roller; and a soft pad mounted on said nip closing member upstream of said drive roller and operable when said drive nip is closed to capture the leading edge portions of the shingled sheets underlying the one which is being fed by said drive roller;

wherein said drive-roller-engaging member is nonresilient, and is thicker than said soft pad so as to define a step operable to positively stop intersheet-friction-feeding of the sheet immediately adjacent the one fed sheet.

2. The sheet restraint means defined by claim 1 including spring means operable to force bias shingled sheets away from said drive roller and toward said nip closing member.

3. The sheet restraint means defined by claim 1 wherein said drive roller is mounted for rotation on a fixed position axis, said nip closing member comprises an inclined pivoted plate whose effective pivot point is upstream of said drive roller, said soft pad when in said nip closing position defining a ramp inclined upward toward the nip formed by said low friction member and said drive roller.

4. The sheet restraint means defined by claim 3 including a fixed position sheet guide having an opening through which said pivoted plate extends when in the nip closing position, and under which said pivoted plate resides when in the nip open position so as to allow unobstructed shingling of sheets while their leading edges are guided by said sheet guide.

5. The sheet restraint means defined by claim 4 including a U-shaped spring straddling said drive roller and operable to physically push the leading edge of shingled sheets toward said pivoted plate.

6. A closable drive nip adapted to receive the leading edge of the foremost one of a group of sheets which are shingled thereto by operation of a combing wheel, comprising:

a drive roller operable to feed the foremost shingled sheet in a given direction downstream of said roller;

a nip closing member spaced from said drive roller to define a drive nip;

means operable to produce relative movement between said drive roller and said nip closing member to effect closing of said drive nip;

a low friction, drive-roller-engaging member mounted on said nip closing member and cooperating with said drive roller to physically push the leading edge of the foremost shingled sheet against said drive roller; and a recessed surface on said nip closing member upstream of said drive roller defining a step operable when said drive nip is closed to positively stop and capture the leading edge portions of the shingled sheets underlying the one which is being fed by said drive roller, to thereby inhibit feeding of the sheet immediately underlying the one fed sheet.

7. The drive nip defined by claim 6 including a soft rubber-like pad mounted on said recessed surface.

8. The drive nip defined by claim 7 wherein said drive roller is mounted for rotation on a fixed position axis, said nip closing member comprises an inclined pivoted plate whose effective pivot point is upstream of said drive roller, said drive roller engaging member comprises low friction means, said soft pad when in said nip closing position defining a ramp inclined upward toward the nip formed by said low friction means and said drive roller.

9. The drive nip defined by claim 8 including a fixed position sheet guide having an opening through which said pivoted plate extends when in the nip closing position, and under which said pivoted plate resides when in the nip open position so as to allow unobstructed shingling of sheets while their leading edges are guided by said sheet guide.

10. The drive nip defined by claim 9 including force means operable to physically push the leading edge of shingled sheets away from said drive roller and toward said pivoted plate.

11. The drive nip defined by claim 10 wherein said low friction means is a nonresilient pad, and said soft pad is thinner than said low friction pad and abuts said low friction pad to form an obstructing step upstream of said nip, said step being operable to additionally capture the leading edge portion of at least the sheets underlying the one fed sheet, which sheets may tend to move due to intersheet-friction.

* * * * *